US012727627B2

(12) United States Patent
Shanks

(10) Patent No.: US 12,727,627 B2
(45) Date of Patent: Sep. 8, 2026

(54) DOUBLE-GRADED WAIST AND HIP LOWER GARMENTS AND METHODS OF MANUFACTURE

(71) Applicant: Mandy Shanks, Columbia, MO (US)

(72) Inventor: Mandy Shanks, Columbia, MO (US)

( * ) Notice: Subject to any disclaimer, the term of this patent is extended or adjusted under 35 U.S.C. 154(b) by 523 days.

(21) Appl. No.: 18/322,476

(22) Filed: May 23, 2023

(65) Prior Publication Data

US 2023/0380514 A1 Nov. 30, 2023

Related U.S. Application Data

(60) Provisional application No. 63/345,954, filed on May 26, 2022.

(51) Int. Cl.
*A41H 3/00* (2006.01)
*A41B 9/14* (2006.01)

(52) U.S. Cl.
CPC . *A41B 9/14* (2013.01); *A41H 3/00* (2013.01)

(58) Field of Classification Search
CPC ... A41B 9/14; A41H 3/00; A41H 3/02; A41H 3/007; A41H 3/04; A41H 1/00; A41H 3/06
USPC ..... 33/17 A, 12
See application file for complete search history.

(56) References Cited

U.S. PATENT DOCUMENTS 155,322 A * 9/1874 Lemley ..... A41H 3/00 33/12
2,689,402 A * 9/1954 Breitbart ..... A41H 3/00 33/17 A
2,972,188 A * 2/1961 Kaufman ..... A41H 3/00 33/12
4,137,634 A * 2/1979 Klamar ..... A41H 3/00 33/12
5,570,533 A * 11/1996 Vouyouka ..... A41H 3/002 33/12
5,757,661 A * 5/1998 Surville ..... A41H 3/007 702/155
6,539,636 B1 * 4/2003 Jennings ..... A41H 3/02 33/563
6,978,549 B2 * 12/2005 Ellis ..... A41H 3/00 33/12

(Continued)

FOREIGN PATENT DOCUMENTS

EP 3114948 B1 10/2019
KR 20060002830 A 1/2006
NL 2022419 A 7/2019

OTHER PUBLICATIONS

De Raeve et al., "Mass Customization, Business Model for the Future of Fashion Industry." 3rd Global Fashion International Conference, Madrid: Complutense University, 2012.

(Continued)

*Primary Examiner* — Peter J Macchiarolo
*Assistant Examiner* — Anna Josephine Saunders
(74) *Attorney, Agent, or Firm* — Armstrong Teasdale LLP

(57) ABSTRACT

A pattern assembly of a plurality of lower garments is provided. The pattern assembly includes a pattern of one of the plurality of lower garments. The pattern includes a waistband portion in a first size in a first grading and a hip portion in a second size in a second grading, the hip portion extending from the waistband portion. The first size in the first grading is different from the second size in the second grading.

18 Claims, 4 Drawing Sheets

(56) References Cited

U.S. PATENT DOCUMENTS

| | | | | |
|---|---|---|---|---|
| 7,398,133 | B2 * | 7/2008 | Wannier | G06Q 30/02 700/130 |
| 2002/0138170 | A1 * | 9/2002 | Onyshkevych | G06Q 30/06 700/130 |
| 2003/0226266 | A1 * | 12/2003 | Ellis | A41H 1/00 33/17 R |
| 2005/0022708 | A1 * | 2/2005 | Lee | G06Q 10/087 112/186 |
| 2012/0290119 | A1 * | 11/2012 | Gillette | G06Q 50/04 700/132 |
| 2014/0165265 | A1 * | 6/2014 | Tulin | A41D 1/06 2/234 |
| 2014/0379515 | A1 * | 12/2014 | Hornbuckle | A41H 3/007 705/26.5 |
| 2016/0183617 | A1 * | 6/2016 | McKinney | A41H 3/007 345/419 |
| 2016/0361190 | A1 * | 12/2016 | Caden | A41C 1/10 |
| 2019/0005559 | A1 | 1/2019 | Hornbuckle | |
| 2019/0254359 | A1 * | 8/2019 | Braverman | A41C 3/10 |
| 2020/0367589 | A1 * | 11/2020 | Keel | A41H 1/02 |
| 2021/0076753 | A1 * | 3/2021 | Johnson | A41B 9/001 |
| 2023/0380514 | A1 * | 11/2023 | Shanks | A41B 9/14 |

OTHER PUBLICATIONS

Dove, T, "Women's Clothing Choices are Being Inhibited by Poor Fit", Advances in Physical Ergonomics and Human Factors. AHFE 2017. Advances in Intelligent Systems and Computing, vol. 602, Springer, DOI: https://doi.org/10.1007/978-3-319-60825-9_37.

* cited by examiner 102
100
112
132
126
124
120
XL/L
L/XL
M/L
S/M
104-d
133
104
117
108
116
110
114
130
XL
L
M
S
XS
L/M
M/S
S/SX
XS/S
Side Seam
Waist
134
Center Back
(Place on Fold)

114-u
114-l
116-XS
116-M
Center Front - Fold
Crotch
134-XS
134-L
Leg
104-d
121-w-xs
S/XS
M/S
M/L
123-w-m
104-s
136
118-XS
118-M
106

DOUBLE-GRADED WAIST AND HIP LOWER GARMENTS AND METHODS OF MANUFACTURE

CROSS-REFERENCE TO RELATED APPLICATIONS

This patent application claims the benefit of U.S. Provisional Patent Application No. 63/345,954, filed on May 26, 2022 titled "DOUBLE-GRADED WAIST AND HIP LOWER GARMENTS AND METHODS OF MANUFACTURE," the entire contents and disclosures of which are hereby incorporated herein by reference in their entirety.

BACKGROUND

The field of the disclosure relates generally to manufacturing of lower garments, and more particularly, to methods and patterns for manufacturing lower garments having improved fit through waist and hip double-grading.

In the mass manufacture of garments, patterns are generated and typically graded to produce garments in different sizes for different persons. Garments are manufactured according to the graded patterns.

Known lower garments and known grading methods for manufacturing lower garments are disadvantaged in some aspects, however, and improvements are desired.

BRIEF DESCRIPTION OF THE DRAWINGS

Advantages of the present disclosure will become better understood when the following detailed description is read with reference to the accompanying drawings in which like characters represent like parts throughout the drawings, wherein.

Figures 1A, 1B, 1C:
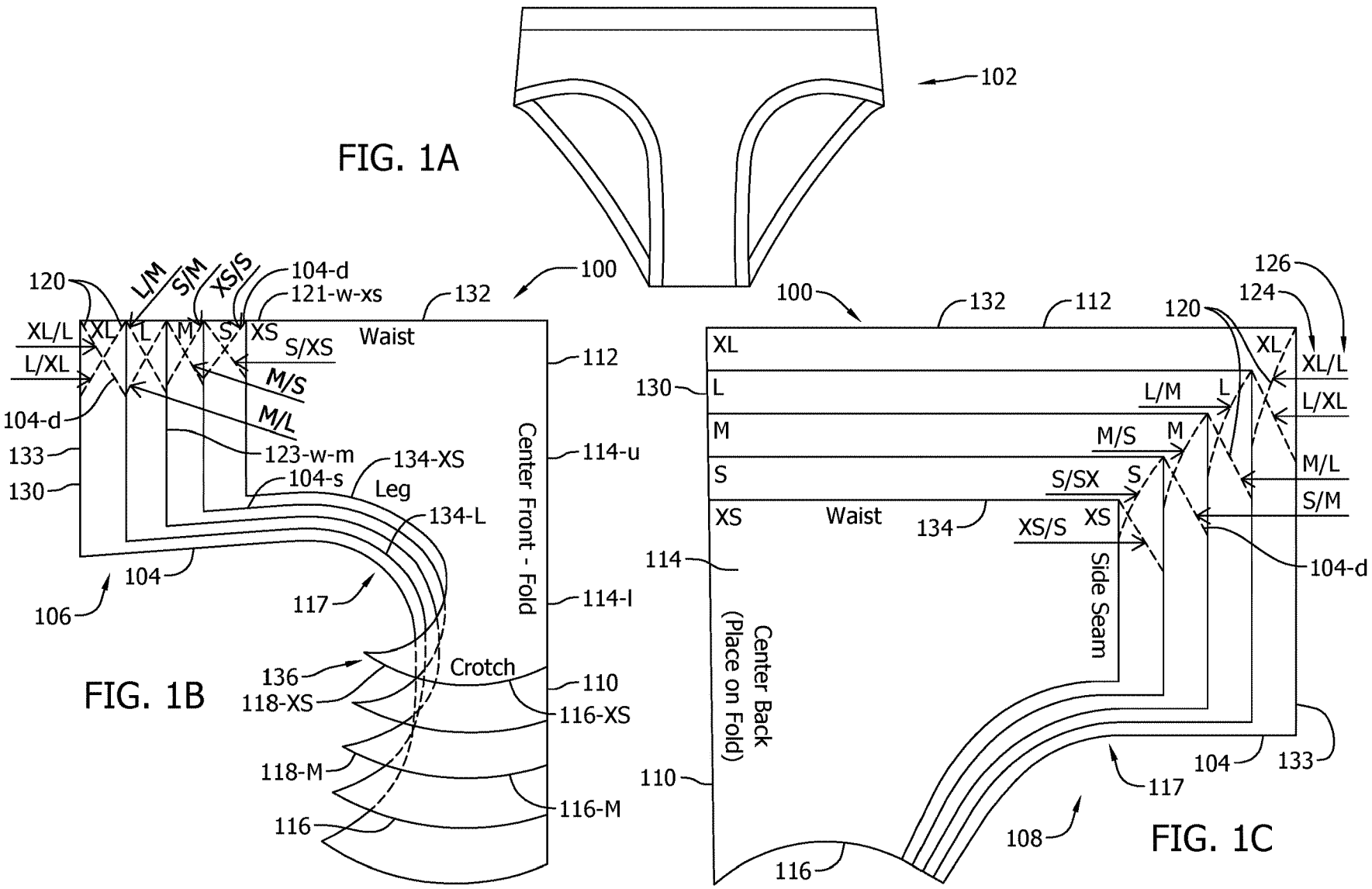
FIG. 1A is a front view of an example lower garment.
FIG. 1B is a front portion of an example pattern assembly for manufacturing the lower garment shown in FIG. 1A.
FIG. 1C is a back portion of the example pattern shown in FIG. 1B.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

This disclosure includes pattern assemblies and methods for manufacturing double-graded lower garments. As used herein, a lower garment is a garment that at least includes a portion donned on a wearer's lower torso. A lower garment may include, for example only, underwear, swimwear, boxers, or pants, and for a wearer of any age or gender. While described in the context of example embodiments of underwear or undergarments below, such embodiments are provided for the sake of illustration rather than limitation. The pattern assemblies and methods may be instead used for any lower garment presenting similar needs to the lower garments described. Method aspects will be in part apparent and in part explicitly discussed in the following description.

As conventionally implemented, a garment pattern is increased or decreased proportionally to maintain the shape of the pattern while obtaining relatively smaller or larger garments for different body sizes. Such proportional increase or decrease in the patterns used is referred to herein as "single-graded" or "single-sized" patterning to produce garments. As such, and for example, the waistband of a "large" lower garment would be proportionally larger than in a "small" lower garment, and in generally so would the other dimensional aspects of the garments. Such single-sized patterns and proportions are idealized to theoretically fit a large population of persons having compatible body shapes.

In reality, however, body shapes may vary significantly among different persons that are incompatible with conventionally single-sized garments. For instance, the specific body shape of a wearer typically does not proportionally increase or decrease from another wearer in a different size. Some people tend to carry more weight at the waist area, while other people tend to carry more weight at the hip area. As a result, lower garments manufactured according to conventional grading methods often do not fit some wearers at all, or sub-optimally fit other wearers and therefore negatively affect comfort of the wearer. This is particularly so for persons that may have a body portion that is compatible with a first size (e.g., a small size) and another body portion that is not, presenting an inherent mismatch with a conventional, single-sized garment.

Ill-fitting single-sized lower garments may include, for example, a saggy buttock portion where too much material is provided at the wearer's buttock area, a creepy crotch portion where the lower garment rides up or lack material in the crotch area, a loose waist where the garment waistband rolls down or does not stay in place, or any combination thereof. Because undergarments should fit the shape of the body, the above described problems are more noticeable and bothersome for undergarments than for outerwear. Particularly for females, shopping for properly fitting lower garments can therefore be a frustrating experience, and sometimes is a futile exercise.

Known lower garments such as men's pants have two sizes for a pair of pants, one for a length of the pants and the other for a waist circumference. Such lower garments, however, do not accommodate different body shapes in the hip portion. Longstanding needs in the art therefore remain unfulfilled, and better solutions to lower garment sizing and manufactures is desired.

Methods, pattern assemblies, and lower garments described herein overcome the above described problems and limitations in known single-sized lower garments, pattern assemblies, and methods. Lower garments and patterns described herein are double graded or double sized, where the waist portion and the hip portion may be graded separately, and may have different sizes, thereby providing an improved fit for wearers having body types and shapes that are incompatible with conventional single-sized lower garments. Patterns described herein also include junction lines between the waist portion and the hip portion in different sizes. As a result, the number of patterns of one design is greatly increased, thereby reducing costs in material and simplifying the process of manufacturing while achieving an improved fit for more users at an economical cost.

FIGS. 1A-1C show an example pattern assembly 100 of a lower garment 102. FIG. 1A is a front view of lower garment 102. FIGS. 1B and 1C illustrate a pattern assembly 100 for manufacturing the lower garment 102 show in FIG. 1A. In the depicted embodiment, lower garment 102 is an undergarment for women such as underwear. The assemblies and methods described herein that apply double grading to improve fit of the garment across different body shapes are not limited, however, to women's underwear, or to garments for particular ages or genders of wearers, and may therefore be applied to undergarments and to other types of garments that present similar needs and would benefit from the double graded or double sized features described herein.

In the example embodiment, pattern assembly 100 includes one or more patterns 104. Garment 102 is assembled according to one of patterns 104. In the example embodiment, pattern 104 includes a front portion 106 (FIG. 1B) and a back portion 108 (FIG. 1C). Front portion 106 and back portion 108 are folded along a midline 110 and a half of front portion 106 and a half of back portion 108 are depicted in FIGS. 1B and 1C. Depending on the style of lower garment, front portion 106 and back portion 108 may be the same, or different.

In the example embodiment, pattern 104 includes a waistband portion 112. Waistband portion 112 is sized according to a wearer's size measured at the waist line.

In the example embodiment, pattern 104 also includes a hip portion 114. Hip portion 114 extends from waistband portion 112. Hip portion 114 includes an upper hip portion 114-*u* and a lower hip portion. Upper hip portion 114-*u* extends from waistband portion 112. Upper hip portion 114-*u* sized to surround at least partially a pelvic area of the wearer. Lower hip portion 114-1 extends from Upper hip portion 114-*u*. Lower hip portion 114-1 includes a crotch 116 and defines two leg apertures 117 each sized to receive a leg therethrough.

In the example embodiment, and unlike single-sized garment patterns described above, pattern 104 includes a first grading 124 at waistband portion 112 and a second grading 126 at hip portion 114. First grading 124 is based on a waist circumference, a measurement of a waistline of a wearer. Second grading 126 is based on a hip circumference, a measurement of a hip of the wearer horizontally at the widest part of the wearer's lower torso. First grading 124 and second grading 126 may be separate and/or independent from one another, where first and second gradings 124, 126 may be in different systems and/or ranges, and sizes in first and second gradings may vary separately and/or independently from one another.

In contemplated examples, first grading 124 may be made in extra-small (XS), small (S), medium (M), large (L), or extra-large (XL) gradations. Sizes in letters may be referred to as letter sizing. Second grading 126 may also me made be in XS, S, M, L, or XL gradations. First and/or second grading 124, 126 may alternatively be made in other gradations using numbers like 4, 6, and so on, or a grading based on dimensions of the wearer's body or of the garment in centimeters or inches. Sizes in dimensions may be referred to as dimension sizes. Frist and second gradings 124, 126 may be in different grading from one another. For example, first grading 124 may be in letter sizes, while second grading 126 in a number sizes, or vice versa. First and second gradings 124, 126 may have different ranges of sizes from one another. For example, first grading 124 may range from XS to XL, while second grading 126 ranging from S to extra extra large (XXL), or vice versa. As such, considering the possible combinations of first and second gradings in the garment design, wearers of different body shapes may have a considerable number of sizing options to choose from to achieve the most optimal fit in a manner that is not possible with conventional single-sized garment design. Unlike conventional single-size grading, the double grading of the garment pattern facilitates a disproportional combination of first and second gradings to more optimally meet the fitting needs of certain wearers having body shapes that deviate from assumed body shapes in single-sized garment designs.

In an example embodiment, a size of lower garment 102 is indicated by a size in first grading 124 and also a size in second grading 126, indicating the waist circumference or the hip circumference, respectively. For example, if lower garment 102 has a size of XS/S, the size in first grading 124 for the waist circumference is XS and the size in second grading 126 for the hip portion 114 is S. In FIGS. 1B and 1C, solid lines 130 indicate a same-grading pattern 104-*s*, where first grading 124 is the same as second grading, e.g., XS/XS, S/S, M/M, L/L, XL/XL. In same-grading pattern 104-*s*, edges 132 of pattern 104-*s* at different gradings may be parallel to one another but in different sizes to accommodate the size differences. In some embodiments, the contours 136 of hip portion 114 formed by edges 132 are dissimilar at different sizes. For example, leg edges 134 of front portion 106 are not parallel to one another along at least part of leg edges 134. Curvatures of leg edges 134 may increase as gradings 124, 126 decrease. For example, curvature of leg edge 134-XS is greater than curvature of leg edge 134-L because a wearer has a small hip circumference tends to have small legs. Crotches 116 of different sizes are different to accommodate the changes in buttocks and/or legs. For example, the length of an arc 118-XS of crotch 116-XS is smaller than the length of arc 118-M of crotch 116-M. In known patterns, crotches of lower garments typically are not varied for different sizes, causing ill-fitting in the crotch area.

In the example embodiment, dotted lines show junction lines 120, indicating a different-grading pattern 104-*d*, where first grading 124 and second grading 126 of pattern 104 is different. For example, if pattern 104-*d* has a size of XS/S, waistband portion 112 follows pattern 104 for first grading 124 of size XS, and hip portion 114 follows pattern 104 for second grading of size S, and the junction portion between waistband portion 112 and hip portion 114 follows junction lines 120. As a result, pattern assembly 100 more effectively accommodates people of different body shapes. Junction lines 120 may be a slanted line. Junction lines 120 may be straight or curved. For simplicity, patterns 104-*d* of one grade up or down between first grading 124 and second grading 126 are shown in FIGS. 1B and 1C. Patterns of a plurality of grades up or down may be provided by including junction lines 120 that transition between a pattern in a first grading and a pattern in a second grading. For example, if pattern 104 is for XS/M, one end of junction line 120 extends from an end 121-*w*-*xs* of waistband portion 112 for size XS and the other end of junction line 120 extends from an end 123-*h*-*m* of hip portion 114 for size M. Accordingly, the number of patterns for lower garments 102 in pattern assembly 100 may be up to the product of the number of sizes in first grading 124 and the number sizes in second grading. In the depicted embodiment, sub-patterns for up to 16 lower garments 102 of various sizes may be depicted with pattern assembly 100. In contrast, a conventional pattern of the same number of gradings provides only lower garments of four different sizes. The number of patterns is greatly increased, saving material and simplifying the assembling process of garments, in the meantime providing an improved fit to accommodate different body shapes.

In operation, to assemble lower garment 102, front portion 106 and back portion 108 are unfolded and attached along crotch 116 and hip edges 133.

Lower garment 102 shown in FIGS. 1B and 1C includes front portion 106 and back portion 108 as two separate pieces. Pattern 104 may be in one single piece where crotch 116 is continuous between front portion 106 and back portion 108. In some embodiments, pattern 104 are in three or more pieces. Lower garment 102 is assembled by sewing along edges, which may be indicated in pattern 104.

Figure 2:
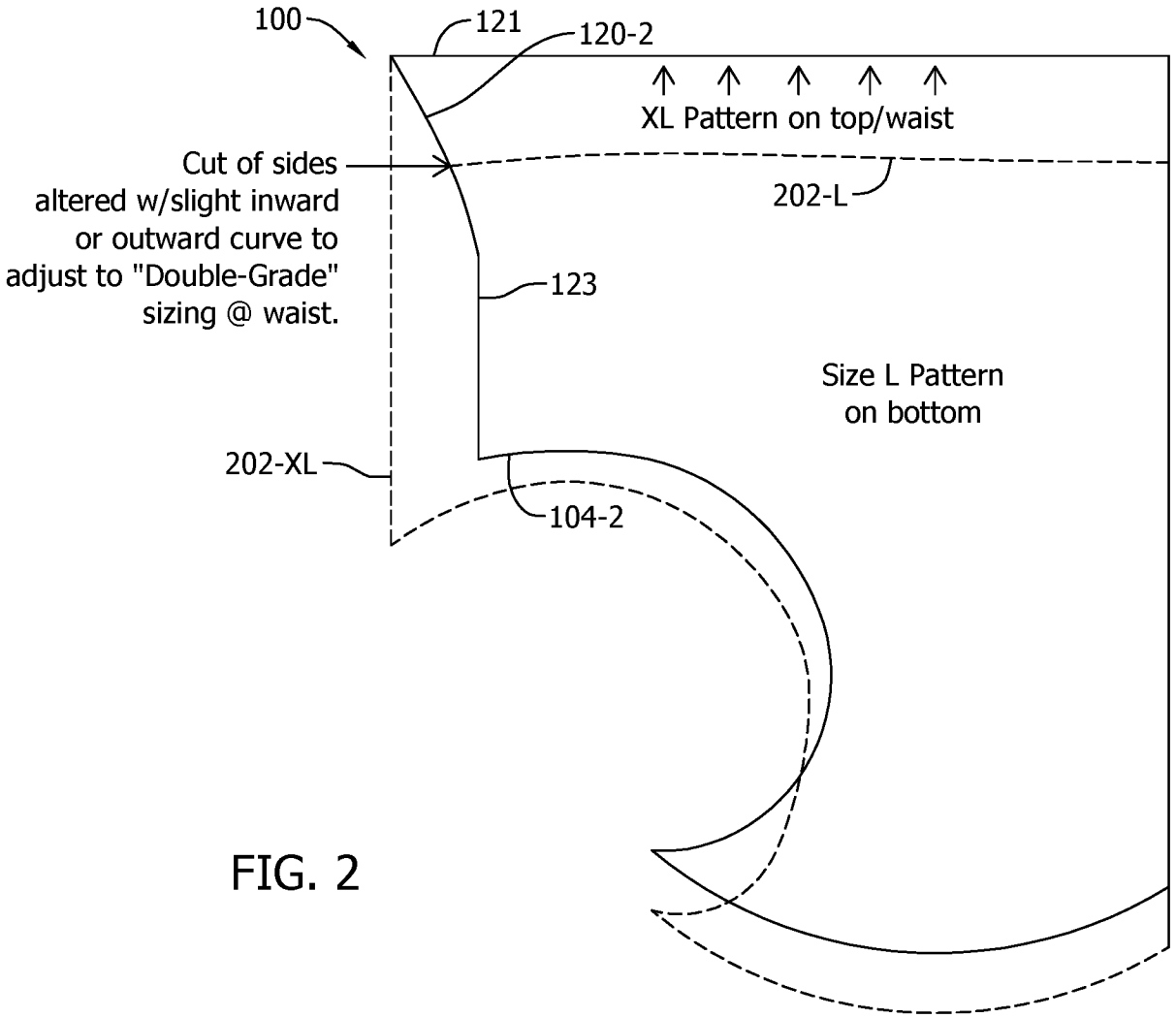
FIG. 2 is another example pattern assembly for manufacturing the lower garment shown in FIG. 1A.

FIG. 2 shows another example pattern assembly 100 having pattern 104-2 (in solid lines). In the depicted embodiment, the gradings of pattern 104-2 are XL/L, where first grading 124 is XL and second grading is L. A dotted line 202-XL is a hip portion of a pattern of XL 104-XL. A dotted line 202-L shows a waistline of a pattern of L 104-L. Pattern 104-2 includes a junction line 120. One end of junction line 120-2 extends from an end 121 of waistband portion of pattern 104-XL. The other end of junction line 120 extends from an end 123 of hip portion of pattern 104-L. Different from junction lines shown in FIGS. 1B and 1C, junction lines 120-2 includes curved. Junction line 120 may be concave, curving inwards.

Figure 3:
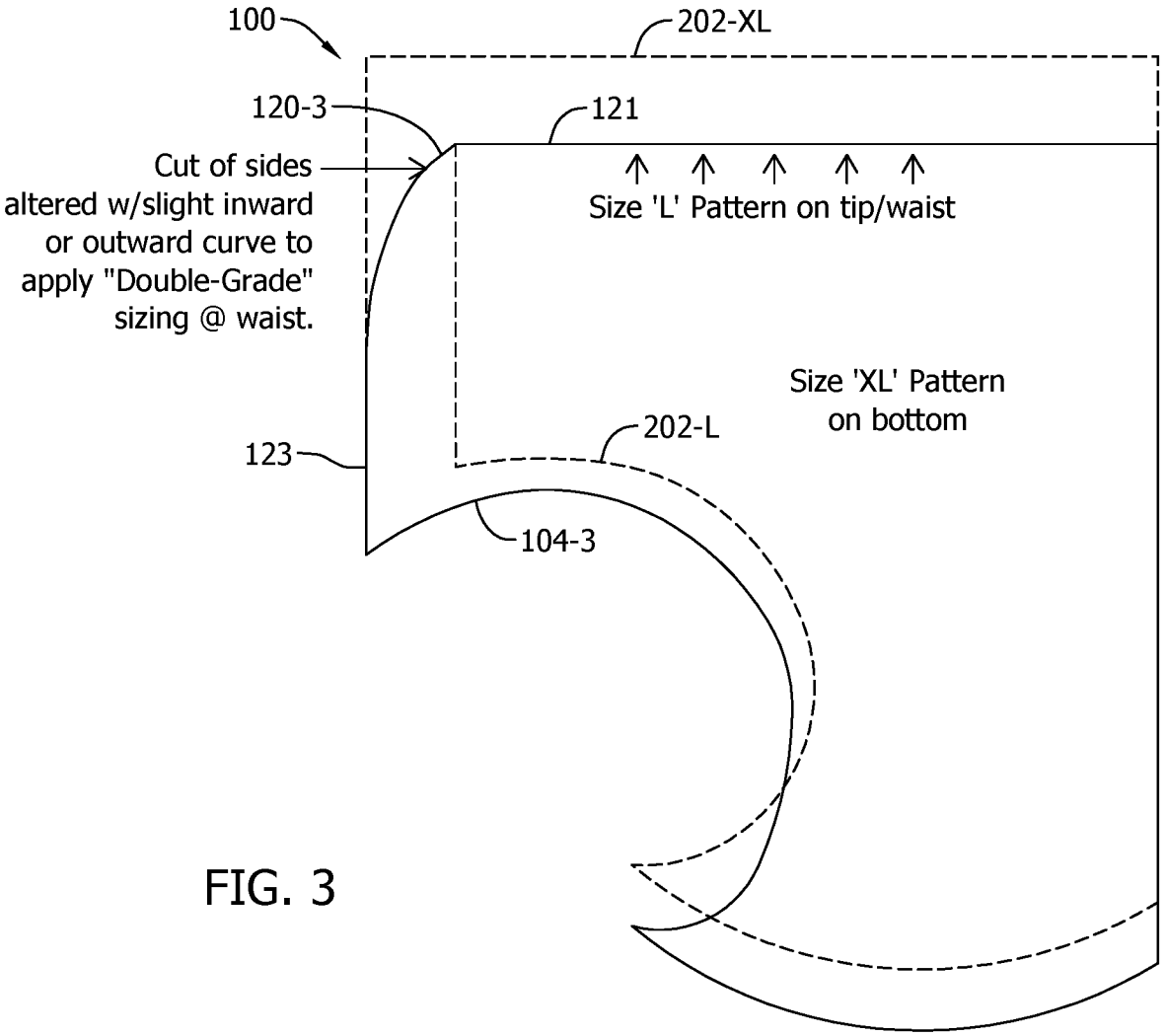
FIG. 3 is one more example pattern for manufacturing the lower garment shown in FIG. 1A.

FIG. 3 shows one more example pattern assembly 100 having pattern 104-3 (in solid lines). In the depicted embodiment, the gradings of pattern 104-3 are L/XL, where first grading 124 is L and second grading is XL. A dotted line 202-L is a pattern of L 104-L at the hip portion. A dotted line 202-XL shows a waistline of a pattern of XL 104-XL. Pattern 104-3 includes a junction line 120-3. One end of junction line 120 extends from an end 121 of waistband portion of pattern 104-L. The other end of junction line 120 extends from an end 123 of hip portion of pattern 104-XL. Different from junction lines shown in FIGS. 1B and 1C, junction lines 120-3 may be curved. Different from junction line 120-2 shown in FIG. 2, junction line 120-3 is convex, curving outwards.

Concave junction lines 120 may be included when first grading 124 is greater than second grading. Convex junction lines 120 may be included when first grading is smaller than second grading. Concave or convex junction lines 120 provide optimized fit by transitioning between waistband portion 112 and hip portion 114.

In contemplated examples, lower garment 102 may be fabricated from a bamboo modal fabric. Bamboo modal fabric is fabricated from bamboo. Stretching process may be included in fabrication process of bamboo modal fabric. The manufacturing process of a bamboo modal fabric includes relatively few toxic chemicals, thereby reducing the need of strict treatment protocols and disposal processes. A bamboo modal fabric is less shrinkable than cotton, thereby maintaining the fit and size of lower garment 102. Bamboo modal fabric is also softer and cooler than cotton, providing a comfortable wearing experience. Bamboo modal fabric is also both static and winkle free, advantageous over cotton and other fabric such as rayon. Other benefits of bamboo modal fabric are that bamboo modal fabric is antibacterial and/or anti-fungal, hypoallergic and/or allergy resistant, eco-friendly, biodegradable, odorless/odor resistant, durable, thermal regulating, moisture wicking, light, absorbent, and stretchy to conform. Bamboo modal fabric is an example material. Lower garment 102 may be fabricated from other suitable material such as cotton, rayon, or polyester. Lower garment 102 may be fabricated with different materials at different portions.

Figure 4:
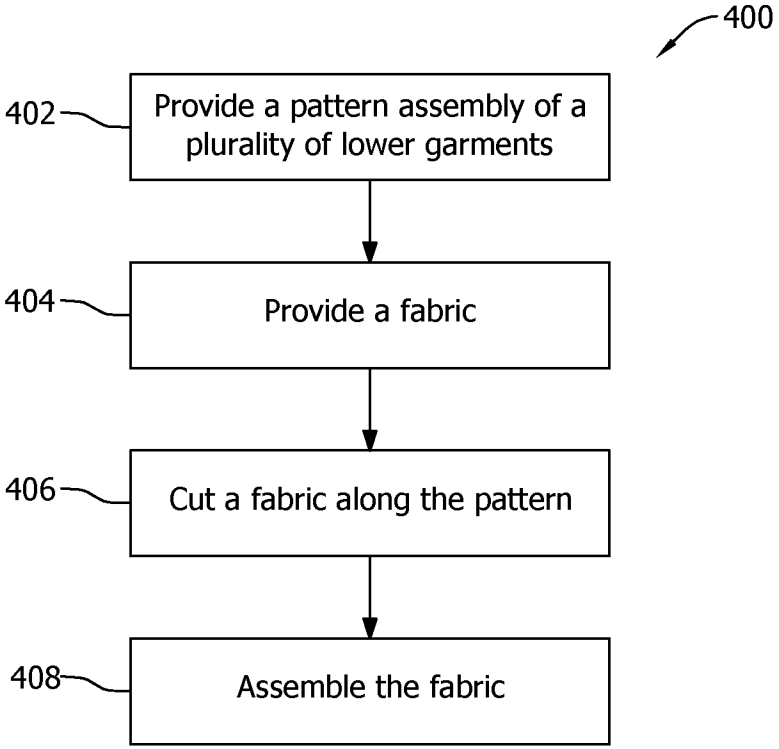
FIG. 4 is a flow chart of an example method of manufacturing a lower garment using pattern assemblies shown in FIGS. 1B-3.

FIG. 4 is a flow chart of an example method 400 of manufacturing a double-sized lower garment. Method 400 includes providing 402 a pattern assembly. The pattern assembly may be pattern assemblies 100 described above. Method 400 also includes providing 404 a fabric. Method 400 further includes cutting 406 the fabric along a pattern. The cut fabric is assembled 408 into a lower garment. For example, front portion 106 and back portion 108 are attached together using mechanisms such as sewing or heat-sensitive adhesives.

While example patterns and methods of manufacturing double sized garments have now been described, it is appreciated that the lower garment 102 may be manufactured with other patterns and by other methods with similar benefits.

In one aspect, a pattern assembly of a plurality of lower garments is provided. The pattern assembly includes a pattern of one of the plurality of lower garments. The pattern includes a waistband portion in a first size in a first grading and a hip portion in a second size in a second grading, the hip portion extending from the waistband portion. The first size in the first grading is different from the second size in the second grading.

Optionally, the pattern assembly includes a first pattern, a second pattern, a third pattern, and a fourth pattern. The first pattern includes a first waistband portion in the first size in the first grading and a first hip portion in a first size in the second grading. The second pattern includes a second waistband portion in a second size in the first grading and a second hip portion in the second size in the second grading. The third pattern includes a third waistband portion in the first size in the first grading and a third hip portion in the second size in the second grading. The fourth pattern includes a fourth waistband portion in the second size in the first grading and a fourth hip portion in the first size in the second grading. The hip portion includes a crotch in the second size in the second grading. The pattern includes a junction line, and the waistband portion transitions into the hip portion along the junction line, the junction line including a slanted line. The first size in the first grading is smaller than the second size in the second grading, and the waistband portion curves outwards toward the hip portion along the junction line. The first size in the first grading is greater than the second size in the second grading, and the waistband portion curves inwards toward the hip portion along the junction line. A hip portion of a first size in the second grading has a dissimilar contour from the hip portion of the second size in the second grading.

In another aspect, a lower garment is provided. The lower garment includes a waistband portion in a first size in a first grading and a hip portion in a second size in a second grading, the hip portion extending from the waistband portion, wherein the first size in the first grading is different from the second size in the second grading.

Optionally, the hip portion includes a crotch in the second size in the second grading. The lower garment includes a junction line, and the waistband portion transitions into the hip portion along the junction line, the junction line including a slanted line. The first size in the first grading is smaller than the second size in the second grading, and the waistband portion curves outwards toward the hip portion along the junction line. The first size in the first grading is greater than the second size in the second grading, and the waistband portion curves inwards toward the hip portion along the junction line. A hip portion of a first size in the second grading has a dissimilar contour from the hip portion of the second size in the second grading. The lower garment is fabricated with a bamboo modal fabric. The lower garment is an undergarment.

In one more aspect, a method of manufacturing a lower garment is provided. The method includes providing a pattern assembly of a plurality of lower garments. The pattern assembly includes a pattern of one of the plurality of lower garments. The pattern includes a waistband portion in a first size in a first grading and a hip portion in a second size in a second grading, the hip portion extending from the waistband portion. The first size in the first grading is different from the second size in the second grading. The method also includes providing a fabric, cutting the fabric along the pattern, and assembling the fabric into the one of the plurality of lower garments.

Optionally, in the method, the pattern assembly includes a first pattern, a second pattern, a third pattern, and a fourth pattern. The first pattern includes a first waistband portion in the first size in the first grading and a first hip portion in a first size in the second grading. The second pattern includes a second waistband portion in a second size in the first grading and a second hip portion in the second size in the second grading. The third pattern includes a third waistband portion in the first size in the first grading and a third hip portion in the second size in the second grading. The fourth pattern includes a fourth waistband portion in the second size in the first grading and a fourth hip portion in the first size in the second grading. The hip portion includes a crotch in the second size in the second grading. The pattern includes a junction line, and the waistband portion transitions into the hip portion along the junction line, the junction line including a slanted line. Providing a fabric further includes providing a bamboo modal fabric. A hip portion of a first size in the second grading has a dissimilar contour from the hip portion of the second size in the second grading.

Example embodiments of pattern assemblies, garments, and methods of manufacturing garments are described above in detail. The systems and methods are not limited to the specific embodiments described herein but, rather, components of the systems and/or operations of the methods may be utilized independently and separately from other components and/or operations described herein. Further, the described components and/or operations may also be defined in, or used in combination with, other systems, methods, and/or devices, and are not limited to practice with only the systems described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A pattern assembly of a plurality of lower garments, the pattern assembly comprising:

a single pattern of one of a plurality of lower garments, comprising:

a waistband portion in a first size in a first grading; and a hip portion in a second size in a second grading, the hip portion extending from the waistband portion, wherein the first size in the first grading is different from the second size in the second grading, the pattern further comprising a first junction line and a second junction line, the waistband portion transitioning into the hip portion along the first junction line and the second junction line, the first junction line extending from an end of the waistband portion of the first size in the first grading to an end of the hip portion in the second size in the second grading and indicating a first lower garment having a waistband portion in the first size in the first grading and the hip portion in the second size in the second grading, the second junction line extending from an end of the waistband portion in the second size in the second grading to an end of the hip portion in the first size in the first grading and indicating a second lower garment having the waistband portion in the second size in the second grading and the hip portion in the first size in the first grading.

2. The pattern assembly of claim 1, wherein the pattern assembly includes:

a first pattern comprising:

a first waistband portion in the first size in the first grading; and a first hip portion in a first size in the second grading;

a second pattern comprising:

a second waistband portion in a second size in the first grading; and a second hip portion in the second size in the second grading;

a third pattern comprising:

a third waistband portion in the first size in the first grading; and a third hip portion in the second size in the second grading; and a fourth pattern comprising:

a fourth waistband portion in the second size in the first grading; and a fourth hip portion in the first size in the second grading.

3. The pattern assembly of claim 1, wherein the hip portion includes a crotch in the second size in the second grading.

4. The pattern assembly of claim 1, wherein the first size in the first grading is smaller than the second size in the second grading, and the waistband portion curves outwards toward the hip portion along the first junction line and the second junction line.

5. The pattern assembly of claim 1, wherein the first size in the first grading is greater than the second size in the second grading, and the waistband portion curves inwards toward the hip portion along the first junction line and the second junction line.

6. The pattern assembly of claim 1, wherein a hip portion of a first size in the second grading has a dissimilar contour from the hip portion of the second size in the second grading.

7. A lower garment comprising:

at least one of a single pattern of the lower garment, the pattern comprising:

a waistband portion in a first size in a first grading; and a hip portion in a second size in a second grading, the hip portion extending from the waistband portion, wherein the first size in the first grading is different from the second size in the second grading, the pattern further comprising a first junction line and a second junction line, the waistband portion transitioning into the hip portion along the first junction line and the second junction line, the first junction line extending from an end of the waistband portion of the first size in the first grading to an end of the hip portion in the second size in the second grading and indicating a first lower garment having a waistband portion in the first size in the first grading and the hip portion in the second size in the second grading, the second junction line extending from an end of the waistband portion in the second size in the second grading to an end of the hip portion in the first size in the first grading and indicating a second lower garment having the waistband portion in the second size in the second grading and the hip portion in the first size in the first grading.

8. The lower garment of claim 7, wherein the hip portion includes a crotch in the second size in the second grading.

9. The lower garment of claim 7, wherein the first size in the first grading is smaller than the second size in the second grading, and the waistband portion curves outwards toward the hip portion along the first junction line and the second junction line.

10. The lower garment of claim 7, wherein the first size in the first grading is greater than the second size in the second grading, and the waistband portion curves inwards toward the hip portion along the first junction line and the second junction line.

11. The lower garment of claim 7, wherein a hip portion of a first size in the second grading has a dissimilar contour from the hip portion of the second size in the second grading.

12. The lower garment of claim 7, wherein the lower garment is fabricated with a bamboo modal fabric.

13. The lower garment of claim 7, wherein the lower garment is an undergarment.

14. A method of manufacturing a lower garment, comprising:

providing a pattern assembly of a plurality of lower garments, the pattern assembly including:

a single pattern of one of the plurality of lower garments, including:

a waistband portion in a first size in a first grading; and a hip portion in a second size in a second grading, the hip portion extending from the waistband portion, wherein the first size in the first grading is different from the second size in the second grading, the pattern further including a first junction line and a second junction line, the waistband portion transitioning into the hip portion along the first junction line and the second junction line, the first junction line extending from an end of the waistband portion of the first size in the first grading to an end of the hip portion in the second size in the second grading and indicating a first lower garment having a waistband portion in the first size in the first grading and the hip portion in the second size in the second grading, the second junction line extending from an end of the waistband portion in the second size in the second grading to an end of the hip portion in the first size in the first grading and indicating a second lower garment having the waistband portion in the second size in the second grading and the hip portion in the first size in the first grading;

providing a fabric;

cutting the fabric along the pattern; and assembling the fabric into the one of the plurality of lower garments.

15. The method of claim 14, wherein the pattern assembly includes:

a first pattern including:

a first waistband portion in the first size in the first grading; and a first hip portion in a first size in the second grading;

a second pattern including:

a second waistband portion in a second size in the first grading; and a second hip portion in the second size in the second grading;

a third pattern including:

a third waistband portion in the first size in the first grading; and a third hip portion in the second size in the second grading; and a fourth pattern including:

a fourth waistband portion in the second size in the first grading; and a fourth hip portion in the first size in the second grading.

16. The method of claim 14, wherein the hip portion includes a crotch in the second size in the second grading.

17. The method of claim 14, wherein providing a fabric further comprises providing a bamboo modal fabric.

18. The method of claim 14, wherein a hip portion of a first size in the second grading has a dissimilar contour from the hip portion of the second size in the second grading.

* * * * *